United States Patent [19]

Hardesty

[11] 4,148,539

[45] Apr. 10, 1979

[54] MODULAR PLUG HAVING SUPERIOR DIELECTRIC STRENGTH FOR TERMINATING CORDS

[75] Inventor: Edwin C. Hardesty, Perry Hall, Md.

[73] Assignee: Western Electric Company, Incorporated, New York, N.Y.

[21] Appl. No.: 792,433

[22] Filed: Apr. 29, 1977

[51] Int. Cl.[2] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,699,498 | 10/1972 | Hardesty et al. | 339/64 |
| 3,761,869 | 10/1972 | Hardesty et al. | 339/99 |
| 3,812,449 | 5/1974 | Elm | 339/98 |
| 3,860,316 | 1/1975 | Hardesty | 339/91 |
| 3,954,320 | 5/1976 | Hardesty | 339/99 |
| 3,998,514 | 12/1976 | Hardesty | 339/99 R |
| 4,002,392 | 1/1977 | Hardesty | 33/99 |

*Primary Examiner*—Joseph H. McGlynn
*Attorney, Agent, or Firm*—E. W. Somers

[57] ABSTRACT

A modular plug for terminating a multiconductor cord and adapted to be inserted into a jack to establish electrical connections between cord conductors and contact wires in the jack possesses superior dielectric strength. The plug includes a plastic housing having conductor-receiving cells extending between a closed end of the plug and a chamber common to all the conductors with the spacing of the cells differing from that of the jack wires. Terminal-receiving slots extend between the chamber and an exterior surface of the housing with the length of each slot being parallel to the associated cell and communicating with an exterior surface of the housing through an opening defined by at least one camming surface. The openings are spaced the same as the jack wires and the same as terminals being fed by automatic machinery for insertion. As the terminals are inserted into the openings, they engage the camming surfaces, and are caused to shift laterally as they are seated in the slots so that internal contact portions of the terminals engage electrically the conductors in the chamber while exposed edge surfaces are supported for engagement with the jack wires. Only those portions of the terminals which have been coated with a corrosion-resistant material are exposed while substantial lengths of opposed side edge surfaces of the terminals are in an interference fit with walls of the slots to prevent unintended movement.

19 Claims, 20 Drawing Figures

MODULAR PLUG HAVING SUPERIOR DIELECTRIC STRENGTH FOR TERMINATING CORDS

BACKGROUND OF THE INVENTION

1. Field of the Invention

This invention relates to a device having superior dielectric strength for terminating a cord, and, more particularly, to a modular plug comprising a plurality of terminals which are supported in a plastic housing against unintended movement with only those portions of the terminals that are coated with a corrosion-resistant material being exposed and which engage conductors that are confined in the housing in such a manner that the plug has exceptionally high dielectric strength.

2. Prior Art

Modular plugs are designed to permit a customer, as well as an installer, to insert a plug into a jack and/or to remove the plug from the jack. This provides the customer with the capability of changing cords and/or connecting newly obtained telephones with existing wall terminals. Because of the ease with which telephone handsets may be connected to and disconnected from wall terminals, handsets become portable. Still further, the customer may disconnect a retractile cord, which connects a telephone handset to a base, in order to remove kinks, and then reconnect the cord.

Modular plugs for terminating telephone cords, are known and are shown for example, in U.S. Pat. Nos. 3,699,498 and 3,761,869 which issued Oct. 17, 1972 and Sept. 25, 1973, respectively, both in the names of E. C. Hardesty, C. L. Krumreich, A. E. Mulbarger, Jr. and S. W. Walden.

Modular plugs must be constructed to avoid a reduction in dielectric strength with an accompanying decrease in breakdown voltage which could lead to a loss in service. In order to meet the dielectric strength requirements between adjacent conductors and/or terminals, a plug housing has been constructed with individual ducts or cells for receiving individual ones of the cord conductors with the cells being separated from each other by partitions which extend the height of the cells. This differs from first generation modular plugs in which the conductors were disposed side-by-side, generally in contiguous relation to one another in open-topped troughs.

While the use of individual conductor-receiving cells is beneficial from the standpoint of dielectric strength, their use causes at least one problem. Terminals that are supported in the housing extend between the cells and channels which open to an outside surface of the plug to make connections between the cord and jack wires disposed in a predetermined spacing and received in the aligned channels when the plug is inserted into a jack. However, the thickness of the floor-to-ceiling partitions of the cells causes the spacing of the cells to differ from that of the jack wires. Hence, the terminals must extend between the channels, which have the same centerline spacing as the jack wires, and the cells, which have a centerline spacing different from that of the jack wires.

An alternative to a solution in which the plug connects conductors at one spacing to jack wires at a different spacing is to change the spacing of the jack wires and the spacing at which the terminals are inserted, to that of the conductors. This is not an attractive alternative since it would require modification or replacement of all the existing machinery used in the production of modular plugs and jacks and entail considerable expense.

In a viable solution for accommodating the present jack wire and terminal insertion spacing while holding the conductors at another spacing, the terminals are reoriented within the housing as the terminals are inserted. When the terminals are first inserted into the upper reaches of the housing, the terminals are at the same spacing as the jack wires. As the terminals are driven and fully seated within the housing, the terminals are shifted laterally into essentially vertical planes which are spaced apart at distances that differ from the distances at which the jack wires are spaced apart.

A further problem that manifests itself is the molding of a plug of this size with individual cells for the conductors. Minimizing the lengths of the partitions which form the individual cells would be of help in the molding of the plug by permitting the use of a more compact, stronger core pin; however, in order to avoid a reduction in dielectric strength, any reduction in length of the individual cells must be offset by other features of the plug which enhance its dielectric strength.

The dielectric strength and hence the breakdown voltage may also be reduced because of a portability feature of modular systems in which the cavities of unused modular jacks are at times exposed to corrosive atmospheres. Then, when a plug is inserted into the jack cavity, metal contact wires in the jack which have become corroded engage terminals in the plug, thereby initiating a corrosive attach upon the terminals. Corrosion of the terminals is prevented by plating the exposed portions of the terminals with a corrosion-resistant material.

Priorly, the terminals were constructed with side edges interrupted by cutouts used as pilot holes during the forming of the terminals from a continuous strip. Unfortunately, a portion of the side edges of the terminals adjacent the jack contact wires did not engage the plastic housing when the terminals were seated within the housing. Since only the cutouts of the side edge surfaces of the terminals were plated, the exposed portions adjacent the jack wires were susceptible to corrosion.

A still further problem relates to the support of the terminals within the housing so that unintended movement of the terminals is prevented. Prior art terminals relied on side edge barbs for their support, or on the previously described side edges with intermediate cutouts. The barbs were not wholly satisfactory in preventing pivotal movement of the seated terminals, while the side edges of cutout types of terminals were subject to corrosion. A plug constructed in accordance with this invention includes terminals which are supported within the housing against unintended movement with reduced exposure of non-plated surfaces of the terminals to contaminants.

SUMMARY OF THE INVENTION

A device having superior dielectric strength for terminating a cord is used to make electrical connections between conductors of the cord and components external to the device. In accordance with the invention, the device is a modular plug which includes a dielectric housing having a plurality of conductor-receiving channels spaced apart a first distance and a plurality of terminal-receiving slots associated with the channels. Each of the slots extends generally parallel to and communicates with its associated channel. The lengths of the slots are exposed to and communicate with an exterior surface of the housing through associated openings which are spaced apart a second distance less than the first distance with the portions of the housing which define each opening being connected to the portions of the housing which define the associated slot through at least one camming surface. An electrically conductive terminal which is seated within each of the terminal-receiving slots has an internal contact portion extending into the associated channel for piercing the insulation of and making electrical engagement with a conductor in the channel, and an external contact portion for making electrical engagement with a component external to the housing to establish an electrical connection between the component and the conductor. Each terminal also includes oppositely disposed edge portions which are in compressive engagement with the walls of the housing which define the slot to support the terminal against unintended movement.

When the terminals are inserted into the housing, the camming surfaces are effective to cam the terminals outwardly from the centerline of the housing to reorient the terminals in vertical planes which are offset slightly from the spacing of the external components such as, for example, contact wires of a jack into which the modular plug is inserted.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

The phrase "modular cord system" is intended to describe a system which includes the use of devices mounted in equipment and assembled to ends of cords to permit customer connection of the cords to the equipment. Modular devices also reduce the amount of work required of installers. The economic advantages of modular systems together with the convenience afforded the customer have resulted in widespread acceptance of such systems.

Figure 1:
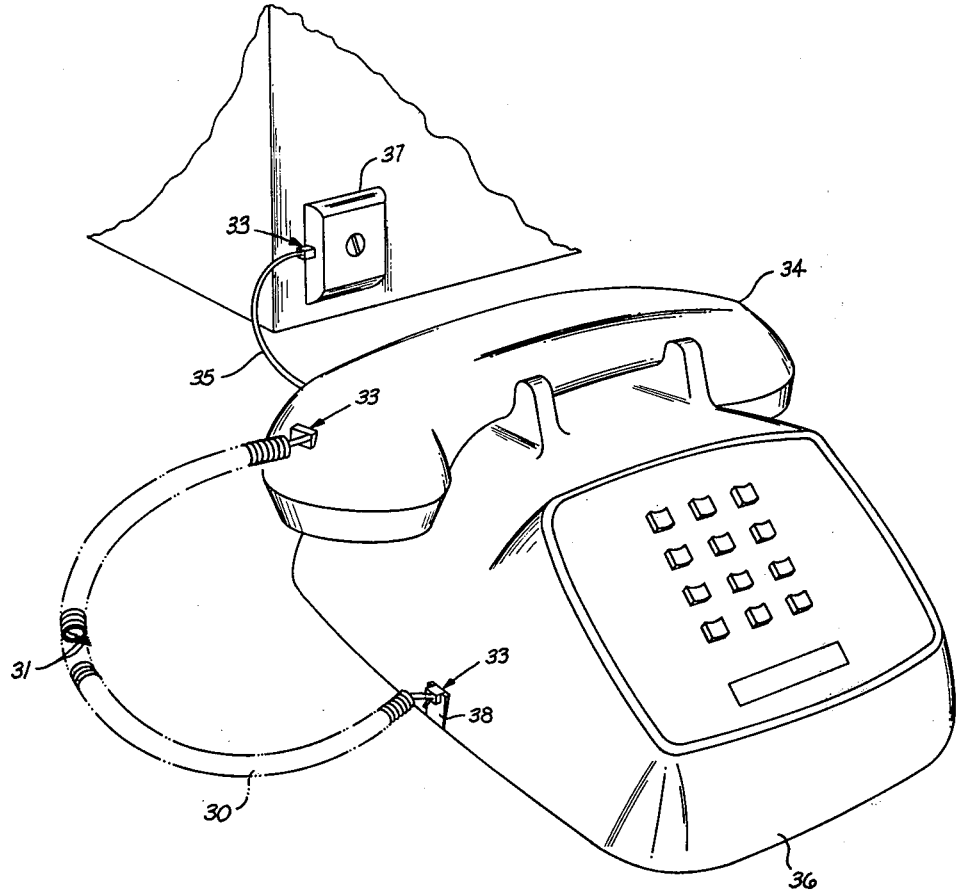
FIG. 1 is a perspective view of a telephone base and handset connected together by a retractile cord which is terminated at each end with a modular plug constructed in accordance with the principles of this invention.

Modular cord systems typically include retractile cords 30—30 and line cords 35—35 (see FIG. 1), each having a plurality of individually insulated flexible conductors 31—31 and terminated with modular plugs 33—33. The flexible conductor 31 may be stranded wire or, preferably, a filamentary core 41 (see FIG. 2) having a plurality of tinsel ribbons 42—42 wrapped helically thereabout and enclosed with a suitable insulative covering 43 such as, for example, that disclosed and claimed in copending commonly assigned application Ser. No. 679,282 filed Apr. 22, 1976 in the names of W. I. Congdon, J. J. Mottine and W. C. Vesperman. The insulated conductors 31—31, preferably, are disposed side-by-side in a planar array and are enclosed in a common jacket 44 made of a suitable plastic material. The final cord configuration has a cross-section with parallel sides and semi-circular ends, and is referred to as a "flat cord." The flat cords are terminated typically with modular plugs of the type shown, for example, in U.S. Pat. No. 3,860,316 issued Jan. 28, 1975 in the name of E. C. Hardesty.

Figure 2:
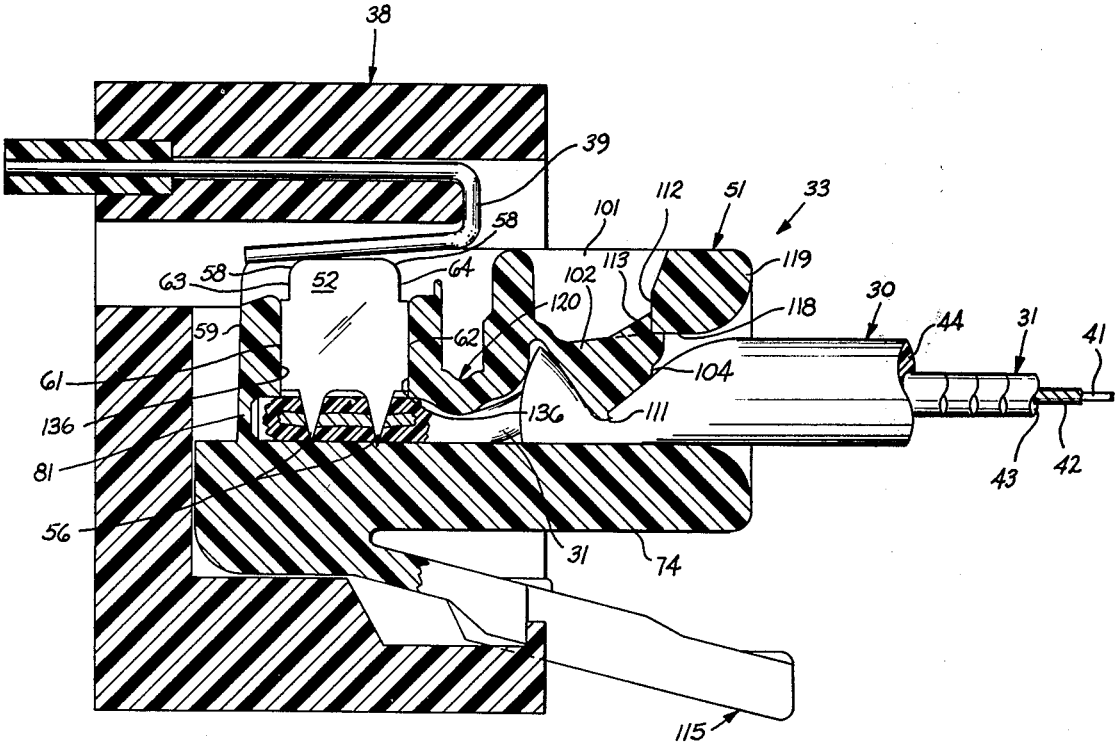
FIG. 2 is an enlarged elevational view partially in section showing a modular plug, which includes the principles of this invention, inserted into a jack of a telephone set to connect a flat cord having conductors arranged in a planar array with components in the jack.

The cord 30 is connected to a telephone handset 34 (see FIG. 1) or base 36, while the cord 35 is connected to a wall terminal 37 or to the base 36, by inserting a plug 33 into a jack 38 (see also FIG. 2). The jack 38 is typically that shown in U.S. Pat. No. 3,990,764, issued Nov. 9, 1976 in the name of C. L. Krumreich, and includes a plurality of wire-like contact elements 39—39 spaced on 0.040 inch centers.

A modular plug 33 constructed in accordance with the principles of this invention has a dielectric strength of at least 1000 volts and includes a housing 51 (see FIGS. 2 and 3A) which is made from a dielectric material, and a plurality of terminals 52—52. The terminals 52—52 connect electrically the conductors 31—31 of the cord end held within the plug 33 and electrical components of telephone apparatus such as, for example, the wire-like contact members 39—39 of the jack 38. The terminals 52—52 are mounted within the housing 51 to be engageable by the contact wires 39—39 in the jack 38.

Portions of the housing 51 and the terminals 52 are described with reference to priorly identified U.S. Pat. No. 3,860,316, to U.S Pat. No. 3,998,514 issued Dec. 21, 1976 in the name of E. C. Hardesty and to U.S. Pat. No. 4,002,392 issued Jan. 11, 1977 in the name of E. C. Hardesty, all incorporated by reference hereinto, and to commonly assigned application Ser. No. 747,456 filed Dec. 3, 1976.

The terminal 52 is made from sheet stock of an electrically conductive material such as, for example, brass or Phosphor-bronze alloy. As can best be seen in FIG. 3A, the terminal 52 has flat faces 53—53 spaced apart by an edge surface 54 from which internal contact portions in the form of tangs 56—56 protrude. When the terminals 52 are seated fully within the housing 51, the tangs 56—56 pierce through the insulation of and engage electrically the conductors 31—31 (see FIG. 2).

The terminals 52—52 include external contact portions which are exposed to an outer surface of the housing 51 and which engage the wire-like members 39—39 (see FIG. 2) in the jacks 38—38 to complete electrical paths from the conductors 42—42 to the external components. Each terminal 52 has an external contact portion in the form of an edge surface 57 having crowns 58—58 of predetermined radii formed at the ends thereof. The crown 58 adjacent a free end 59 (see FIG. 2) of the housing 51 functions to engage the wire-like component 39 of the jack into which the plug 33 is inserted.

Figure 3A:
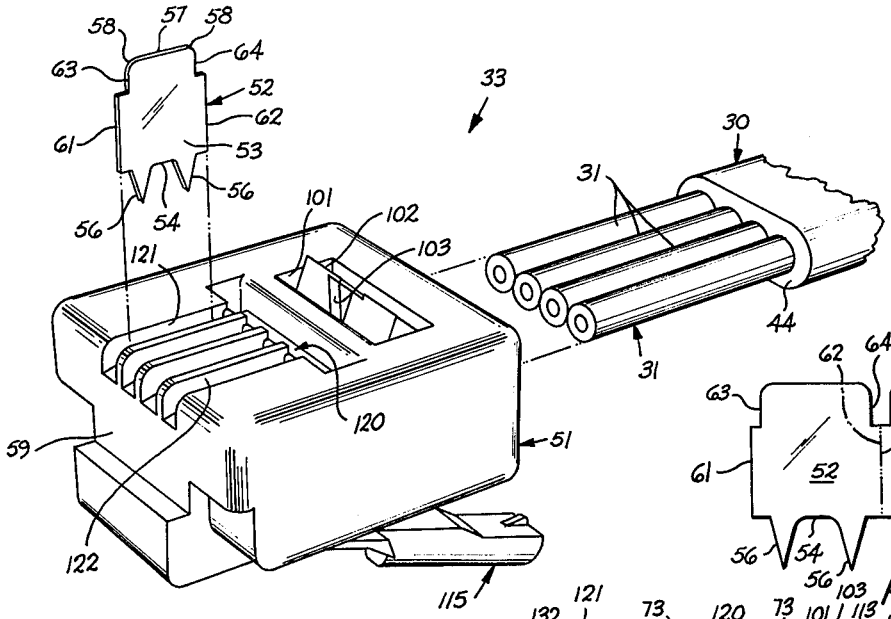
FIG. 3A is a perspective view of a plug housing and a cord aligned for assembly with the housing with particular emphasis on one of a plurality of terminals destined to be seated in one of a plurality of terminal-receiving slots in the housing.

As can be seen in FIG. 3A, each terminal 52 is formed with side edge surfaces 61 and 62 and with side edge surfaces 63 and 64. Each terminal 52 has an overall height of about 0.166 inch with the side surface 61 being about 0.068 inch long and the side surface 63 being about 0.045 inch in length. The edge surfaces 61 and 62 of the terminal 52 are designed to cooperate with the plastic housing 51 to support the terminals in both an armed, i.e. partially inserted, position, and in a final position.

When the terminal 52 is in the fully seated position, the tangs 56—56 extend through the conductors 31—31 and are embedded slightly in the bottoms of the conductor-receiving facilities of the housing 51 (see FIG. 2). This supplements the side edge support of the terminals 52—52 in the housing 51 to prevent unintended movement of the terminals.

Selected surfaces of the terminal 52 are plated with a metal such as, for example, gold, to prevent corrosion. The selected surfaces include the crowns 58—58 since they are exposed and since one of the crowns of each terminal is engaged by a contact wire 39 (see FIG. 2), and further include the edge surface 57.

Figure 3C:
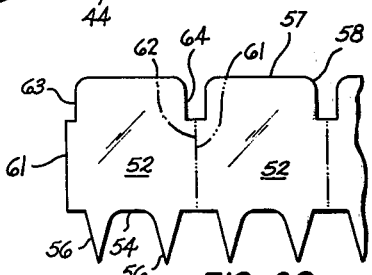
FIG. 3C is an elevational view of a portion of a strip of partially formed terminals constructed in accordance with the principles of this invention.
Figure 3B:
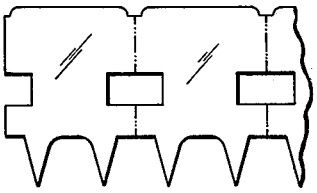
FIG. 3B is an elevational view of a portion of a strip of partially formed prior art type terminals.

Typically, the terminal 52 has been formed with spaced side edges having a cutout for indexing purposes when forming the terminals in a continuous strip (see FIG. 3B). The strip of partially formed terminals 52—52 was plated and sheared to form the terminals. Portions of the side edges along the shear line were not in engagement with the plastic housing, and since these portions were not plated, they were highly suscepticle of becoming corroded.

By constructing the terminal 52 as shown in FIG. 3A, all the edge surfaces not in engagement with plastic when the terminal is seated in the housing 51, are capable of being plated when interconnected together in strip form (see FIG. 3C). These include the surfaces 57, crowns 58—58 and the indented edges 63 and 64.

The plug housing 51 is an unipartite rigid housing (see FIGS. 4 and 5) designed to be constructed from a plastic material, by using conventional injection molding techniques. Plastic material must provide suitable mechanical strength as well as adequate electrical insulation and may be, for example, a polycarbonate, a polyester, a polyamide or related polymer material such as ABS resins. The housing 51 includes the closed free end 59, a cord-input end 72, a terminal-receiving side 73 and a side 74 opposite to the terminal-receiving side 73.

Figure 4:
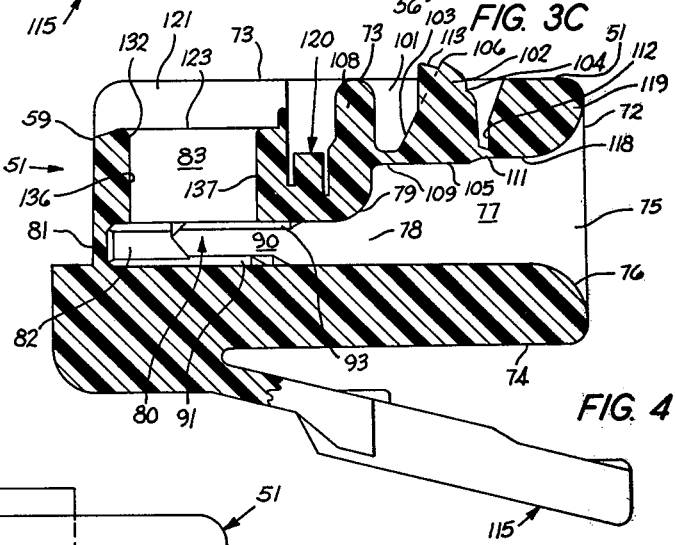
FIG. 4 is an elevational view partially in section and showing a housing of the modular plug prior to insertion of terminals.

As may be observed from FIG. 4, the cord-input end 72 of the housing 51 is formed with a cord-input aperture 75 designed to circumscribe generally the outer periphery of the largest cord expected to be terminated with the plug 33. The unipartite housing 51 is constructed in one piece with no assembly of subparts required and with the aperture 75 formed entirely therewithin. The aperture 75 has a flared entrance 76 which prevents, advantageously, sharp bends in the cord 30 or 35 during customer use. The flared entrance 76 also facilitates insertion of an end portion of the cord 41 after ones of the conductors 31—31 have been inserted.

The aperture 75 opens to a cavity 77 which terminates adjacent a transition section 78. The transition section 78 includes a wall 79 which is tapered along the top and sides as viewed in FIG. 4 to connect the cavity 77 to a plurality of conductor-receiving channels, designated generally by numerals 80—80.

The conductor-receiving channels 80—80 of the housing 51 are constructed to provide a plurality of individual duct-like compartments or cells 82—82 disposed in one tier (see FIGS. 4 and 6) for receiving the conductors 31—31 of a cord 30 or 35. Each of the cells 82—82 is of sufficient size to accept one of the conductors 31—31 of the new "flat" cord. The cell cross-section is generally slightly smaller than the cross-section of the largest expected conductor 31. As can be seen in FIG. 4, the cells 82—82 terminate in a portion 81 of the housing 51.

Further, the housing 51 is constructed to prevent voltage breakdown between adjacent ones of the conductors 31—31 and the terminals 52—52. A voltage breakdown may result, for example, from the ingress of moisture or other contaminants through the free open end 59 of some prior art plugs which corrodes the terminals 52—52. The construction of the housing 51 with the free end 59 being closed by the portion 81 prevents the ingress of moisture or other contaminants and contributes to the 1000 volt dielectric strength of the plug 33.

As can best be seen in FIG. 4, the cells 82—82 extend longitudinally of the housing 51 from the free end 59 to terminal-receiving openings, designated generally by the numeral 83. The cells 82—82 are disposed in one tier and are accessible from the terminal-receiving side 73. It should be understood that this arrangement is designed to accommodate a cord 30 or 35 having a planar array of conductors 31—31. As disclosed in copending application Ser. No. 747,456 filed Dec. 3, 1976, the plug 33 may also be constructed with two tiers of conductor-receiving cells to accommodate cords having old style "round" cords having a non-planar array of conductors.

Figure 6:
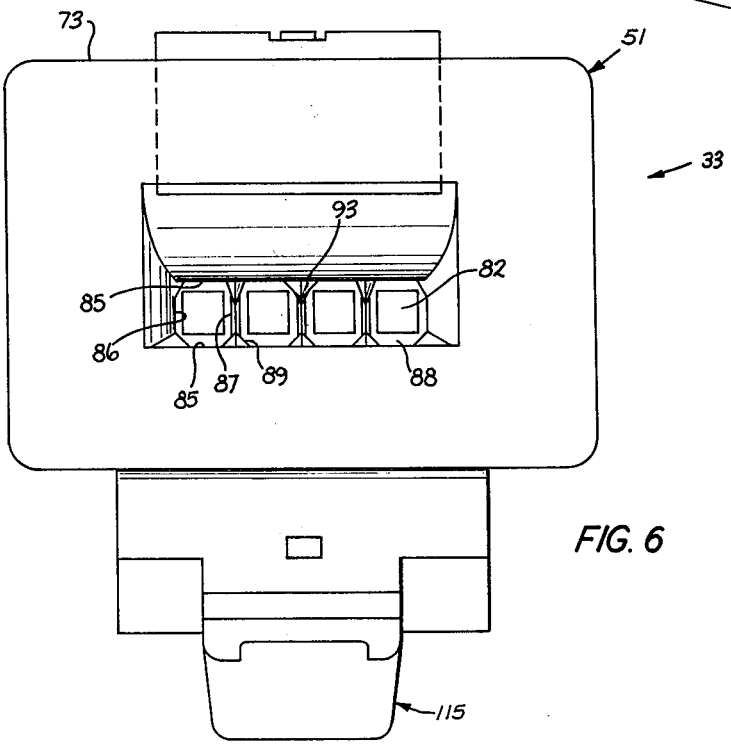
FIG. 6 is an end view of the plug housing shown in FIG. 4 taken along lines 6—6 thereof.
Figure 5:
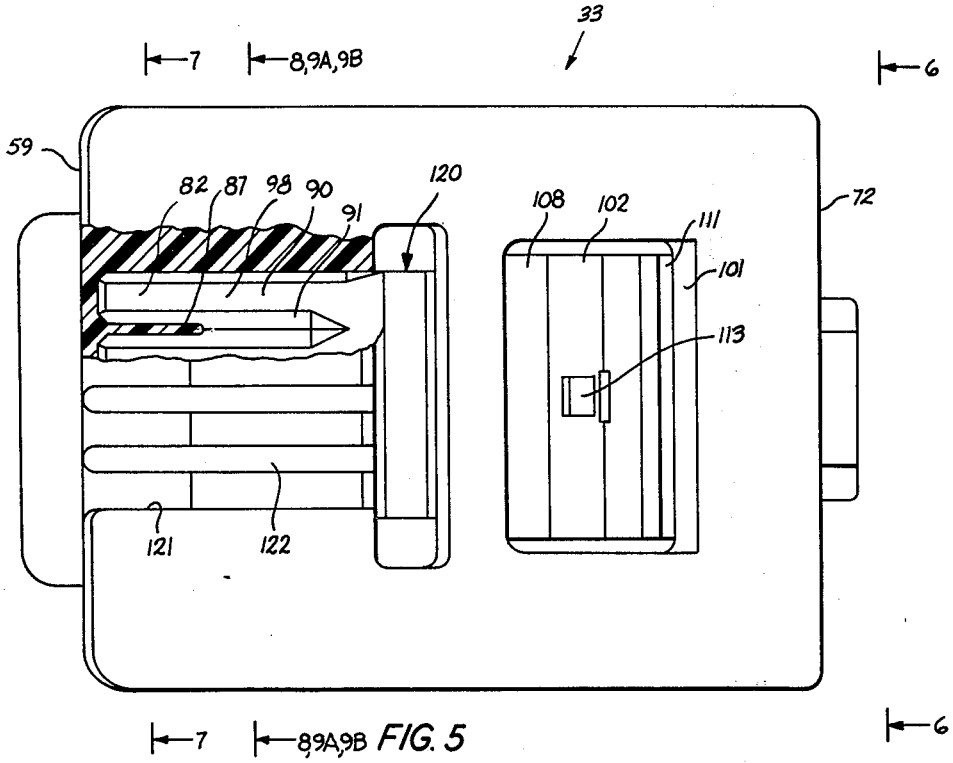
FIG. 5 is a plan view of the plug housing shown in FIG. 4.

Each of the cells 82—82 is enclosed laterally throughout the length thereof and may have a generally square cross-sectional configuration formed by opposing walls 85—85, side walls 86—86 and partitions 87—87 (see FIGS. 5 and 6). The orthogonal intersection of each two adjacent walls which define each cell is replaced with a beveled surface 89 to provide more effective support for the conductor 31 therein during the insertion of the terminal. Also, the entrance to each cell 82, which is oriented toward the cord-input end 72 of the housing, is chamfered along side surfaces 88—88 (see FIGS. 6 and 7). The chamfering of the entrance portion of the cells 82—82 facilitates the insertion of the conductors 31—31.

In addition to the cells 82—82, the conductor-receiving channels 80—80 include a plurality of conductor-receiving troughs 98—98 which are aligned with associated ones of the cells and which are formed in a chamber 90 common to all the conductors 31—31. The troughs 98—98 are formed by a plurality of parallel, longitudinally extending ribs 91—91, which may have a generally triangular cross-sectional shape (see FIGS. 4-5, 8 and 10), which project from a floor 92 of the chamber 90, and which are aligned with the partitions 87—87 of the cells. The ribs 91—91 cooperate with the floor 92 to act as guideways for the conductors 31—31 and thus assist an installer who will insert conductors 31—31 into the channels 80—80.

The chamber 90 is configured to further improve the dielectric strength of the plug 33. At least one additional rib 93 (see FIGS. 4, 6, 8 and 9A) is formed along and depends from a ceiling 94 along the centerline of the housing 51. The rib 93 lengthens the dielectric path between the two centermost conductors 31—31 which have been found to be the most frequent source of breakdown.

Figure 9A:
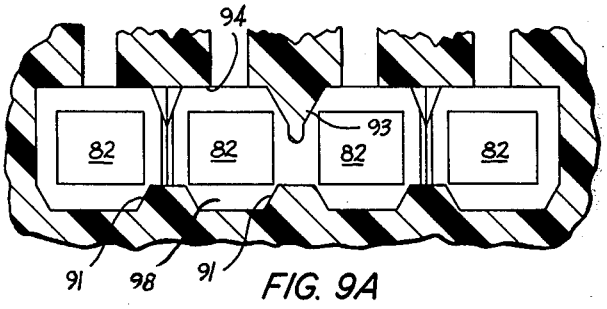
FIGS. 9A and 9B are partial cross-sectional views of alternative embodiments of the plug shown in FIG. 5 and taken along lines 9A—9A and 9B—9B thereof.
Figure 9B:
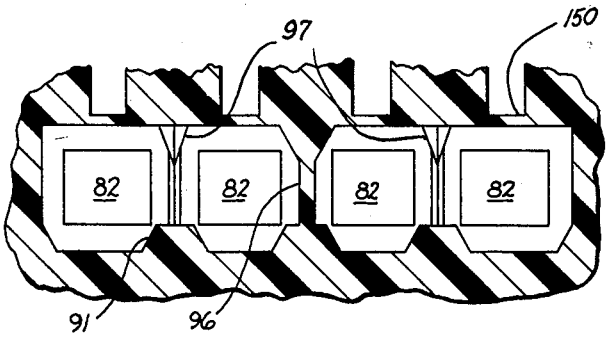
Figure 8:
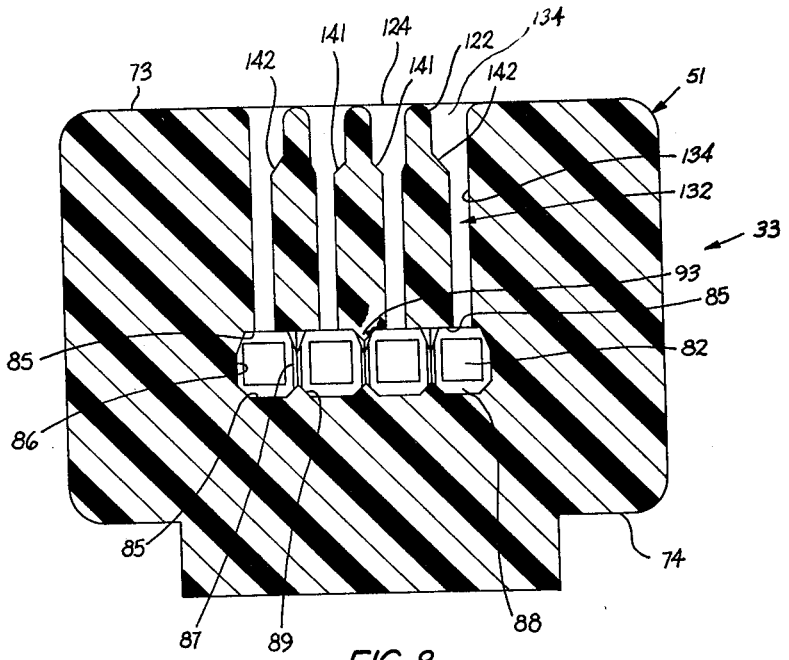
FIG. 8 is a cross-sectional end view of the housing in FIG. 5 and taken along lines 8—8 thereof.

In another embodiment shown in FIG. 9B, a floor-to-ceiling partition 96 aligned with the partition 87 along the longitudinal centerline of the plug housing 51 is continued from the cells 82—82 to the transition section 78. In still a further embodiment, the housing is constructed with the center partition 96 and with ribs 97—97 on each side thereof depending from the ceiling 94 thereof.

An assembler removes a sufficient length of the cord jacket 44 to permit insertion of the conductors 31—31 into predetermined ones of cells 82—82 (see FIG. 3A). Then the assembler inserts the jacketed portion of the cord 30 or 35 to abut the beveled surface 79 of the transition section 78 (see FIG. 11), with the conductors 31—13 extending further along the guideways between the ribs 91—91 and into the cells 82—82.

The housing 51 is also constructed with jacket strain-relief facilities which are actuated after the leading end portion of the jacketed cord 30 or 35 is inserted into the cavity 77. These facilities, which contribute to the feasibility of the unipartite, as opposed to a two piece, housing 51, are disclosed in U.S. Pat. No. 4,002,392 issued Jan. 11, 1977 in the name of E. C. Hardesty.

The strain-relief facilities are disposed within an opening 101 (see FIGS. 4 and 5) which opens to the terminal-receiving side 73 of the housing 51. A jacket anchoring member 102 is disposed within the opening 101 and includes surfaces 103 and 104 which intersect along an edge 106. The anchoring member 102 extends generally across the width of the opening 101 and is connected to a portion 108 of the housing 51 through a plastic hinge 109 oriented toward the free end 59 of the housing, and at its other end, is connected temporarily by a fragile web 111 to a wall 112 adjacent the cord input end 72 the housing. The web 111 supports the anchoring member 102 in the as-manufactured, unoperated position as shown in FIG. 4 to permit insertion of the end portion of the cord into the cavity 77. The surface 103 of the anchoring member 102 is molded to include a stop 113 disposed centrally thereof.

After having inserted an end portion of a cord into the cavity 77, the assembler applies forces to the anchoring member 102 to break the web 111 and to move the anchoring member about its plastic hinge 109. As described in the above-identified U.S. Pat. No. 4,002,392, the stop 113 cooperates with surfaces 112 and 118 to maintain the anchoring member 102 in locked engagement with the cord 30 in the housing 51. This arrangement permits the jacket strain-relief capability of the plug 50 to continue to be effective during customer use when retrograde forces are applied to the cord 41.

Figure 11:
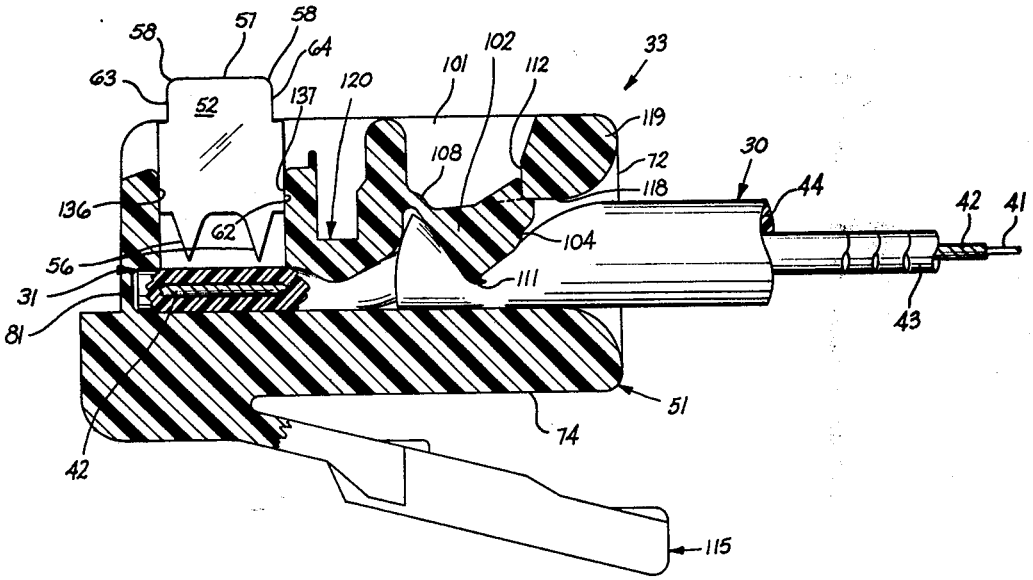
FIG. 11 is an elevational view partially in section of the plug of FIG. 4 with a terminal in an armed, partially inserted position and showing strain-relief facilities in an actuated position to hold the cord within the plug housing.

The plug 33 also includes conductor strain-relief facilities designated generally by the numeral 120 (see FIGS. 4 and 11). The conductor strain-relief facilities 120 are generally of the type shown, for example, in priorly identified U.S. Pat. Nos. 3,860,316 and 4,002,392.

Further, the plug 50 includes a tab 115 for locking the plug within a jack 38 (see FIGS. 4, 6 and 11). The tab 115 and its operation are disclosed in priorly-identified U.S. Pat. No. 3,860,316.

Figure 7:
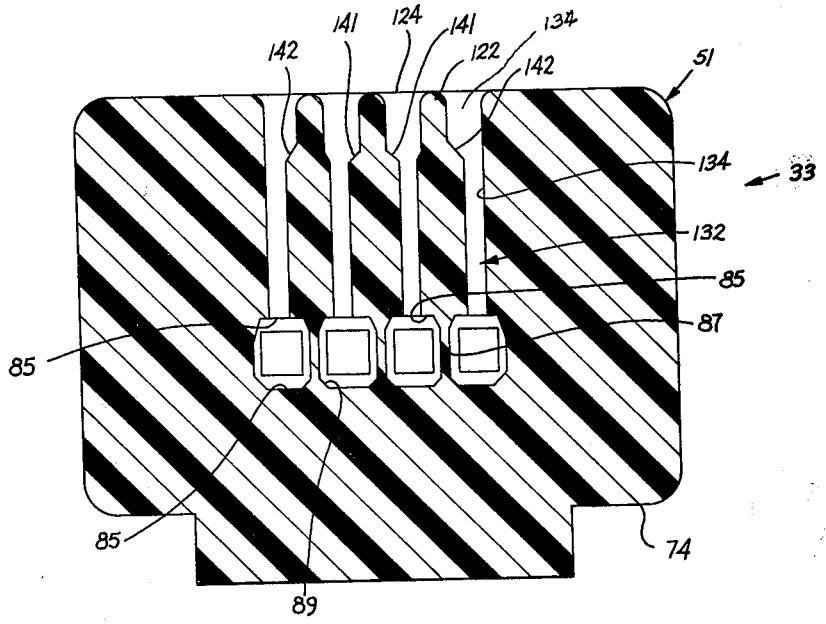
FIG. 7 is a cross-sectional end view of the housing in FIG. 5 and taken along lines 7—7 thereof.
Figure 10:
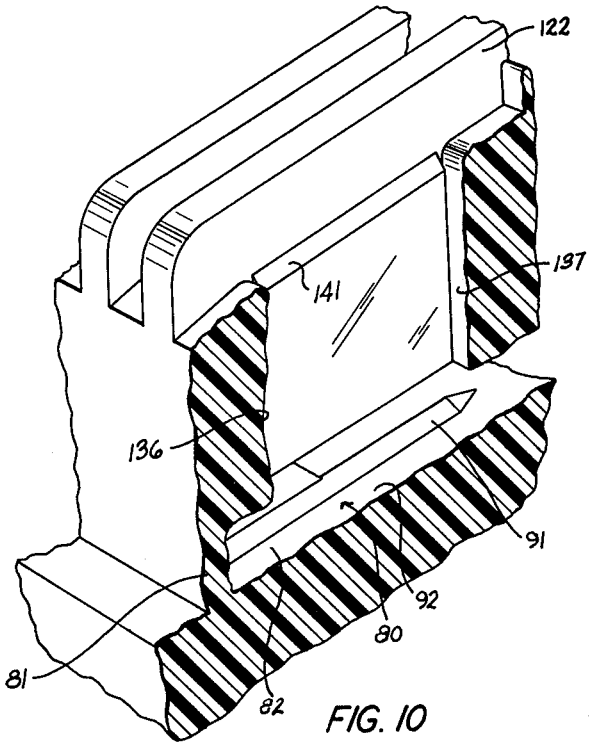
FIG. 10 is an enlarged perspective view of a portion of the housing in the vicinity of the terminal-receiving slots.
Figure 14:
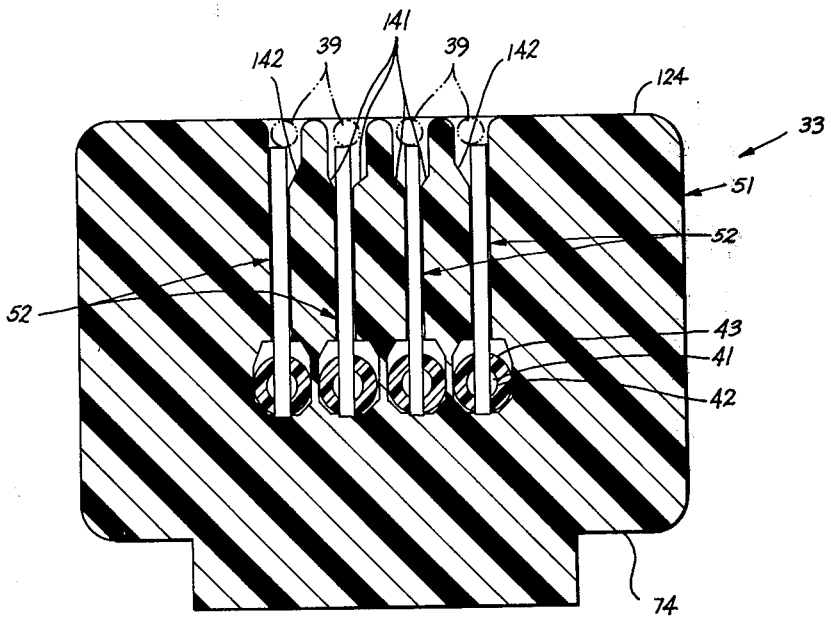
FIG. 14 is an end view of the plug in FIG. 13 after the terminals have been seated fully therein.

In order to mount a plurality of the terminals in the housing 51, the housing is constructed with a well 121 opening to the surface 73 (see FIGS. 3A, 4 and 7). The well 121 has a plurality of spaced, longitudinally extending dielectric separators in the form of fins 122—122 which project from an inner surface 123 of the well 121 toward a plane 124 of the terminal-receiving side 73. The fins 122—122 are spaced apart on 0.040 inch centers in order to correspond to the spacing of wire-like contact members 39—39 of the jack 38. When a plug 33 is inserted into a jack 38, each wire-like contact member 39 is received between two adjacent ones of the fins 122—122 (see FIG. 14).

The housing 51 includes a plurality of terminal-receiving slots 132—132 (see FIGS. 4 and 7), each of which opens to the surface 123 and connects the well 121 with an associated one of the conductor-receiving channels 80—80. The terminal-receiving slots 132—132 extend parallel to the cells 82—82 and include end walls 136—136 and 137—137, which are oriented toward the free end 59 and the cord-input end 72, respectively. The rib 93 depends from the ceiling 94 of the cavity 80 between the two terminal-receiving slots 132—132 which are adjacent the longitudinal centerline of the housing 51.

The conductor-receiving channels 80—80 and the associated terminal-receiving facilities must be constructed within certain restrictions consistent with the dimensions of the associated jacks 38—38 and cords 30 or 35. The 0.040 inch spacing of the external contact elements 39—39 and the size of the jack 38 into which the plug 33 is inserted are standard dimensions used throughout the industry. The external dimension of the insulated conductors 31—31 is fixed. Since partitions adjacent the free end 59 of the housing 51 are used between the conductors 31—31 to provide optimum dielectric strength, the lateral spacing of the conductors held between the ribs 91—91 in alignment with the terminal-receiving slots 132—132 is greater than that between the centerlines between adjacent ones of the fins 122—122.

The terminal-receiving slots 132—132 are designed in order to accept the terminals 52—52 and to reorient the terminals by shifting them laterally. The reorientation is necessary because each of the terminals 52—52 is fed into an insertion position between two of the fins 122—122, or between one of the fins 122 and the side walls of the well 121, on 0.040 inch centers. The lateral spacing between the terminals 52—52 in the pre-insertion position is slightly less than that in the fully seated position. The construction of the plug 33 in accordance with this invention results in increased dielectric strength while maintaining compatability with existing standard jacks 38—38 and jack wire spacing.

In order to shift the terminals 52—52 laterally upon insertion, the terminal-receiving slots 132—132 communicate with the terminal-receiving side 73 of the housing 31 through associated openings 134—134 (see FIGS. 7 and 8) which are specially formed to connect the vertical walls thereof with the top surfaces of the plug housing. As can best be seen in FIG. 7, each of the two centermost slots 132—132 open to opposed camming surfaces 141—141 formed on the fins 122—122. The openings 134—134 spaced farthest from the centerline of the housing 51 each include only one camming surface 142 formed along the surface of a fin 122. Since there is only one camming surface 142 associated with each of the outermost slots 132—132, these must be larger than the camming surfaces 141—141.

Figure 12:
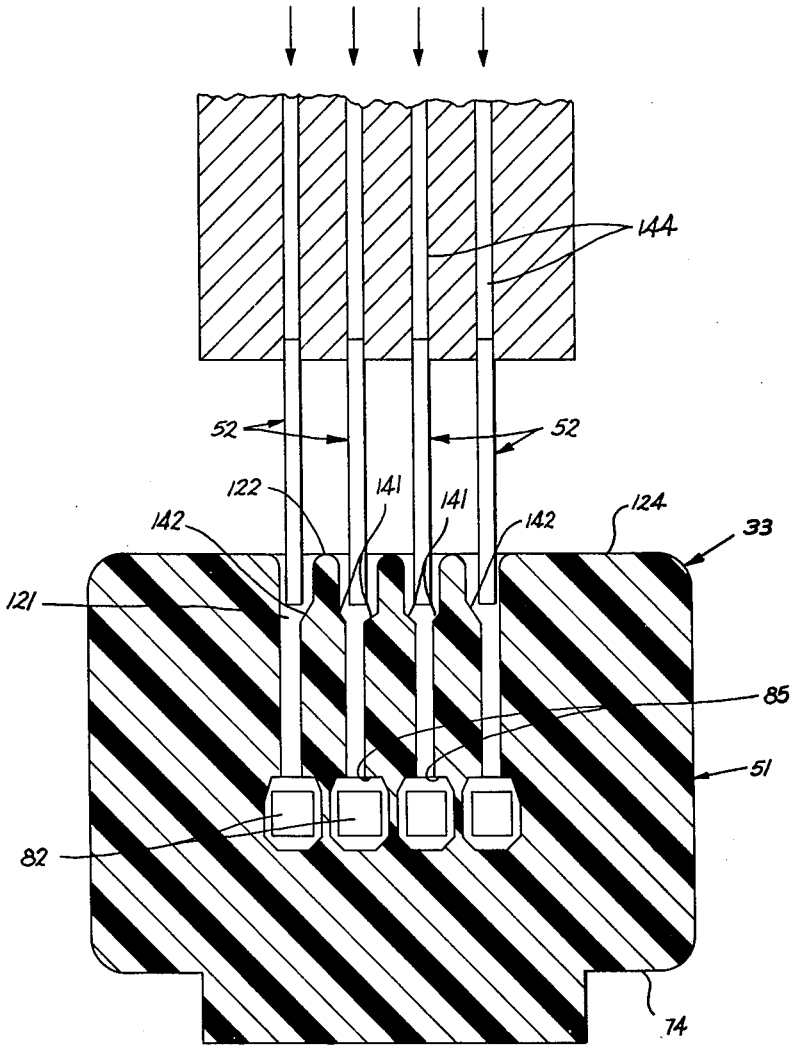
FIG. 12 is an end view of the plug housing of FIG. 4 and showing terminals aligned with openings in the plug housing just prior to insertion.
Figure 13:
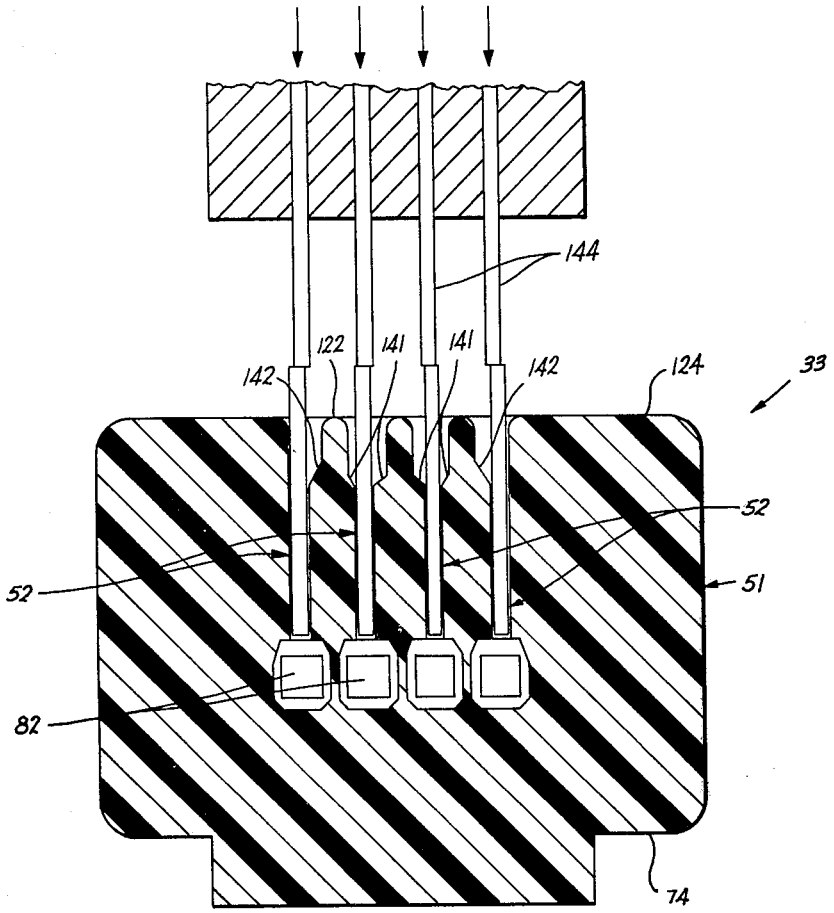
FIG. 13 is an end view of the plug housing of FIG. 12 and showing the terminals being inserted into the housing and shifted laterally into planes aligned with the jack components.

The function of the camming surfaces 141 and 142 in reorienting the terminals 52—52 can best be described by viewing FIGS. 12 and 13. A plurality of insertion rams 144—144 engage priorly fed terminals 52—52 and urge the terminals downwardly into a fully seated position. In FIG. 12 it will be observed that the insertion rams 144—144 are aligned perfectly on a one-to-one basis with the terminals 52—52. As the terminals 52—52 are moved downwardly, the inner two terminals 52—52 engage the camming surfaces 141—141, pivot slightly and resume a generally vertical path of travel (see FIG. 13). The outer two terminals 52—52 engage the camming surfaces 142—142 and are shifted laterally, but more so than the inner two terminals. In the fully seated position (see FIG. 14), the terminals 52—52 engage electrically the tinsel conductors 31—31 although they have been shifted laterally from their original position.

The camming surfaces 141 and 142 are effective in reorienting the terminals 52—52 which are fed to an insertion position in apparatus (not shown) at a predetermined spacing and in causing the terminals to be seated within the housing so as to be engagable by external components spaced apart the predetermined distance and to engage insulated conductors 31—31 spaced apart a distance other than the predetermined distance. This capability permits the use of a combination of individual cells 82—82 and rib extensions 91—91 which contribute to the dielectric strength of at least 1000 volts of the plug 33. At the same time, the continued use of a priorly used "standard" spacing of external components, i.e. the jack wires 39—39, is permitted, thereby obviating the need for expensive changes to assembly apparatus and to jacks already in use.

The terminals 52—52 must be supported within the housing 51 to insure against unintended movement. The support of the terminals 52—52 in the plug 33 may be two-fold. First, since this plug 33 is destined for field assembly to a cord 30 or 35, the terminals 52—52 are assembled to the plug in a manufacturing facility in a partially assembled stage (see FIG. 13) and then shipped to users in the field. This temporary support must be sufficient to prevent the terminals 52—52 from inadvertent canting, laterally or longitudinally, or drop-out. Secondly, permanent support must be provided for the terminals 52—52 when the terminals have been seated fully within the housing 51 (see FIGS. 2 and 14).

When all of the cord conductors are disposed in a planar array, such as, for example, the "flat" cords commonly manufactured today, the terminal support function had been accomplished by the use of side edge barbs as shown in U.S. Pat. No. 3,860,316. The above-mentioned side edge barbs gouge away portions of the end walls which define the terminal-receiving slots and generally provide only point support with the plastic material. It has been found that this arrangement renders the terminal 52 subject to some pivotal movement which may be troublesome to field personnel using hand tools for the final seating. Also, it may not be possible in prior design plugs to extend portions of the housing adjacent the terminal-receiving slots toward the terminal-receiving side of the plug in order to provide additional support for the terminal.

Terminals 52—52 constructed in accordance with the configuration shown in FIG. 3 overcome these difficulties and provide substantial surface support for the terminals. Turning now to the present housing 51, the width of each terminal-receiving slot 132 is about 0.014 inch while ech of the terminals 52—52 is made from 0.012 inch thick sheet stock. Hence, there is insufficient proximity between the flat faces of the terminals 52—52 and the side walls of the terminal-receiving slots 132—132 to support the terminals in the housing without risking undesired canting of the terminals.

The terminals 52—52 are configured along side edges for engaging the plastic material of the housing to support the terminals against unintended movement. The terminal-receiving slots 132—132 are dimensioned lengthwise between the end walls 136—136 and 137—137, respectively, to provide an interference fit with the terminals 52—52 received therein (see FIG. 15). In order to provide the interference fit, each terminal 52 has an overall length of about 0.134 inch while each terminal-receiving slot 132 has an overall length of about 0.126 inch.

The cooperation of the edge surfaces of the terminals 52—52 and the end surfaces 136 and 137 of the terminal-receiving slots 132—132 provides suitable support for the terminals in both the temporary, armed, and fully seated positions. As can be observed from FIG. 15, the insertion of the terminals 52—52 into the terminal-receiving slots 132—132 causes the edge surfaces 61—61 and the edge surfaces 62—62 to deform the end surfaces 136—136 and 137—137 of the openings which may include slight shearing of the plastic. The end walls 136—136 and 137—137 reform generally into grooves, the walls of which are in clamping compressive engagement with the edge surfaces and adjacent portions of the side edge surfaces 53—53 of the terminals. This arrangement advantageously provides a longer support surface for the terminals 52—52 than priorly constructed terminals having barbs formed on the sides thereof (see, for example, priorly identified U.S. Pat. No. 3,860,316) and is especially effective in preventing canting of the terminals in the slots 132—132.

This arrangement advantageously results in a continuous end support surface for the terminals 52—52 and is especially helpful when providing a plug 33 armed with the terminals in a temporary position for shipment to field users. When the terminal 52 is in a temporary or armed position with the tips of the tangs 56—56 spaced slightly above conductor-receiving facilities, substantial portions of the edge surfaces 61 and 62, uninterrupted by cutouts, for example, are in engagement with the end walls of the housing 51. When the terminal 52 is in an armed, partially inserted position, approximately 0.033 inch of the overall height protrudes above the housing surface, and approximately 0.078 inch protrudes above the well surface.

The configuration of the terminals 52—52 and of the terminal-receiving slots 132—132 also cooperate to protect the terminals against corrosion which could result in a reduced voltage breakdown strength. As can best be seen in FIG. 3C, the indented surfaces 63 and 64 of each terminal, which are used for indexing a strip of the terminals, and the crown surfaces 58—58 used for camming the jack wires 39—39 are capable of being plated along with the top edge surface 57. Hence, those surfaces of the terminals 52—52 which are exposed during use will have been plated. The non-plated surfaces 61 and 62 which are formed when the terminals are sheared from the continuous strip of partially formed terminals engage the plastic of the slots 132—132 in an interference fit (see FIG. 15). This reduces the surface area of the terminals 52—52 which is exposed to the atmosphere and hence reduces corrosion of the terminals.

Figure 16:
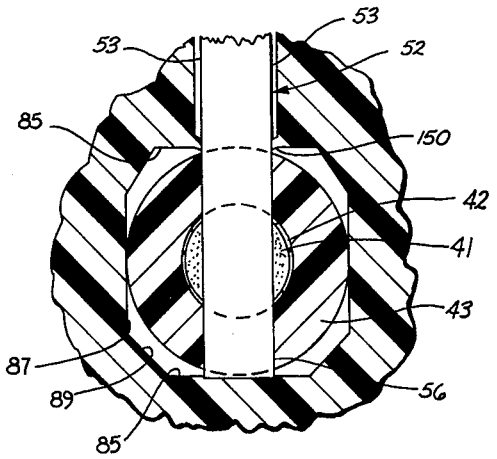
FIG. 16 is an enlarged detail view of the engagement of one of the terminals with a conductor.
Figure 15:
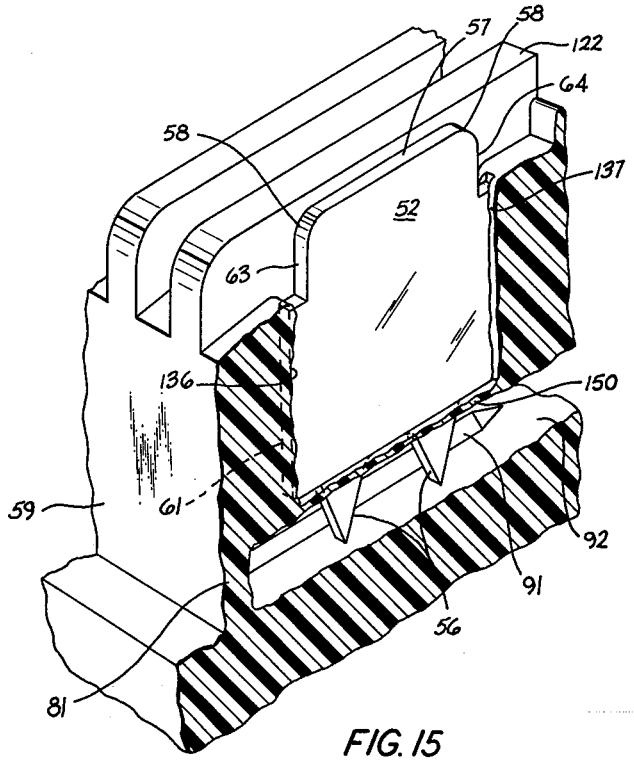
FIG. 15 is an enlarged perspective view showing one of the terminals seated in the plug housing with a portion of the housing broken away to show one of the conductor receiving cells with the conductor removed therefrom for purposes of clarity.
Figure 17:
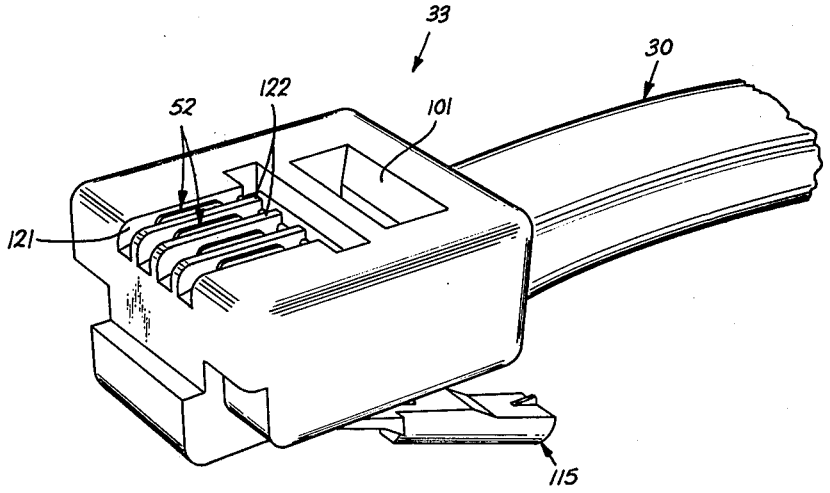
FIG. 17 is an enlarged perspective view of a modular plug assembled to an end of a telephone cord.

To further enhance the corrosion protection of the terminals 52—52, each of the slots 132—132 may be formed with a thin, e.g. 0.005 inch, divider wall 150 between the slots and the common chamber 90 and the cells 82—82 (see FIGS. 9B and 15). When the terminal 52 is driven to a fully seated position, the terminal punches through the divider wall 150. This causes the separated portions of the divider wall 150 moved downwardly as shown in FIG. 16 with the terminal 52 to flex upwardly into clamping engagement with the terminal side surfaces 53—53. This advantageously prevents contaminants from entering the chamber 90 from the slots 132—132 and corroding the unplated tanges 56—56 which would adversely offset the dielectric strength of the cells. This is an important consideration when building the housing with the common chamber 90.

An alternative arrangement is to form the terminal-receiving slots with a restricted area adjacent the chamber 90 so that when a terminal is inserted and seated, the plastic forming the restriction forms a seal with the surfaces of the terminal. Either this partial closing of the interior of each slot 132 or a full closing as disclosed herebefore is effective to prevent the ingress of contaminants into the chamber 90.

While this invention has been described with reference to an unipartite housing 51, the invention is not so limited. It would be within the scope of this invention to construct a two piece plug such as that shown in priorly identified U.S. Pat. Nos. 3,699,498 and 3,769,867.

It is to be understood that the above-described arrangements are simply illustrative of the invention. Other arrangements may be devised by those skilled in the art which will embody the principles of the invention and fall within the spirit and scope thereof.

What is claimed is:

1. A device for making electrical connections between components external to the device and conductors of a cord, which comprises:

a dielectric housing comprising a plurality of conductor-receiving channels with centers spaced apart a first distance, and a plurality of associated terminal-receiving slots with centers aligned with those of the channels and spaced apart said first distance, said slots communicating with the channels and with an exterior surface of the device through openings which at the exterior surface have centers spaced apart a second distance that is less than said first distance, each said opening being defined by at least one camming surface, which is effective to reorient a terminal inserted into the opening such that the terminal will be seated within the associated slot and channel along the aligned centers thereof to engage a conductor in the channel; and an electrically conductive terminal seated within each of the terminal-receiving slots, said terminal having an internal contact portion extending into the associated channel for piercing the insulation of and making electrical engagement with a conductor in the channel, having an external contact portion for making electrical engagement with a component external to the housing to establish an electrical connection between the component and the conductor, and having oppositely disposed edge portions in compressive engagement with walls of the housing which define the terminal-receiving slot to support the terminal against unintended movement.

2. The device of claim 1, wherein each of the terminals includes tangs formed along one edge surface thereof for engaging electrically the conductor, a top surface having curved end portions for engaging a component external to the device, and opposed side edge surfaces which are indented adjacent the curved portions of the top surface, the top surface and the indented portions being coated with a corrosion-resistant material.

3. The device of claim 1, wherein the housing includes a closed free end and an open cord-input end, the conductor-receiving channels each including a substantially laterally enclosed cell and an aligned trough, the troughs being formed in a chamber to which the terminal receiving slots open, the cells extending from the closed end to the chamber.

4. The connector of claim 3, which also includes at least one rib depending from a surface of the chamber opposite a floor of the chamber and extending from the conductor-receiving cells toward the cord-input end along the longitudinal centerline of the housing.

5. The device of claim 3, wherein each terminal-receiving slot communicates with its associated conductor-receiving channel through a restricted opening, the insertion of a terminal into each slot causing plastic material which forms the restricted opening to engage the side surfaces of the terminal to seal effectively the common chamber from the slot.

6. The device of claim 3, wherein each terminal-receiving slot is separated from the associated conductor-receiving channel by a frangible web of plastic material which is penetrable by the terminal upon seating of a terminal in the slot to cause the web to reform into clamping engagement with side surfaces of the terminal.

7. The device of claim 3, wherein the chamber includes spaced ribs which extend from a floor of the chamber toward the terminal-receiving slots to form the troughs.

8. The connector of claim 7, wherein each of two conductors of the cord are disposed parallel to and spaced equidistantly on each side of a longitudinal axis of the housing and the rib which is aligned with the longitudinal axis of the housing and which separates the centermost two conductor-receiving troughs extends from the floor of the chamber to a surface of the chamber opposite the floor and to which the slots open.

9. A device for making an electrical connection between a cord, which includes a plurality of conductors, and components external to the device, which comprises:

a dielectric housing which includes a plurality of conductor-receiving channels with centers spaced apart a first distance, and a plurality of associated terminal-receiving slots having centers aligned with those of the channels, each of the slots communicating with the associated channel, the lengths of the slots being exposed to and communicating with an exterior surface of the device through associated openings which at the exterior surface have centers spaced apart a second distance that is less than said first distance, the portions of the housing which define each opening being connected to portions of the housing that define the associated slot through at least one camming surface which is effective to reorient a terminal inserted into the opening such that the terminal will be seated in the associated slot and channel along the aligned centers thereof to engage a conductor in the channel; and an electrically conductive terminal seated within each of the terminal-receiving slots, said terminal having an internal contact portion extending into the associated channel for piercing the insulation of and making electrical engagement with a conductor in the channel, and having an external contact portion having an edge surface for making electrical engagement with a component external to the housing to establish an electrical connection between the component and the cord.

10. The device of claim 9, wherein each of the terminals include tangs formed along one edge surface thereof for engaging electrically the conductor, and a surface having curved end portions for engaging a component external to the device, and opposed side edge surfaces which are indented adjacent the curved portions of the top surface, the top surface and the indented portions being coated with a corrosion-resistant material.

11. The device of claim 9, wherein the housing includes a closed free end and an open cord-input end, the conductor-receiving channels each including a substantially laterally enclosed cell and an aligned through, the troughs being formed in a chamber to which the terminal-receiving slots open, the cells extending from the closed end to the chamber.

12. The connector of claim 11, which also includes at least one rib depending from a surface of the chamber opposite a floor of the chamber and extending from the conductor-receiving cells toward the cord-input end along the longitudinal centerline of the housing.

13. The device of claim 11, wherein each terminal-receiving slot is separated from its associated conductor-receiving channel by a flangible web of plastic material which is penetrable by the terminal, and such that the insertion of a terminal into one of the slots causes the web to reform its clamping engagement with the side surfaces of the terminal.

14. The device of claim 11, wherein each terminal-receiving slot communicates with the associated conductor-receiving channel through a restricted opening, the insertion of a terminal into each slot causing plastic material which forms the restricted opening to engage the side surfaces of the terminal to seal effectively the common chamber from the slot.

15. The device of claim 11, wherein the chamber includes spaced ribs which extend from a floor of the chamber toward the terminal-receiving slots to form the troughs.

16. The connector of claim 15, wherein the ribs have a generally triangular cross-sectional shape.

17. The connector of claim 15, wherein each of two conductors of the cord are disposed parallel to and spaceed equidistantly on each of a longitudinal axis of the housing and the rib which is aligned with the lontitudinal axis of the housing and which separates the centermost two conductor-receiving troughs extends from the floor of the chamber to a surface of the chamber opposite the floor and to which the slots open.

18. A device for making an electrical connection between a cord, which includes a plurality of conductors, and components external to the device, which comprises a dielectric housing having a closed free end and an open cord-input end, and which includes a plurality of conductor-receiving channels with said centers spaced apart a first distance, and a plurality of terminal-receiving slots associated with the channels and spaced apart said distance, each of the slots extending generally parallel of and communicating with the associated channel, the lengths of the slots being exposed to and communicating with an exterior surface of the device through openings which at the exterior surface have centers that are spaced apart a second distance that is less than said first distance, the portions of the housing which define each opening being connected to the exterior surface of the housing through at least one camming surface which is effective to reorient a terminal which is inserted into the opening such that the terminal will enter the associated slot and channel to engage a conductor in the channel, each of the conductor-receiving channels terminating at an inner end thereof at a portion of the housing adjacent the free end and extending into a chamber to which the terminal-receiving slots open, the chamber extending from the terminal-receiving slots and toward the cord-input end of the housing.

19. A cord which is terminated with a plug for electrically connecting the cord to a jack, which comprises:

a cord, which includes:

a plurality of individually insulated conductors; and a plastic jacket enclosing the plurality of conductors; and a plug which is assembled to at least one end of the cord and which comprises:

a dielectric housing which includes a plurality of conductor-receiving channels with centers spaced apart a first distance, and a plurality of associated terminal-receiving slots having centers aligned with those of the channels, each of the slots communicating with the associated channel and with an exterior surface of the device through an associated one of a plurality of openings which at the exterior surface have centers spaced apart a second distance that is less than the first distance, the portions of the housing that define each opening being connected to the exterior surface of the housing through at least one camming surface which is effective to reorient a terminal inserted into the opening such that the terminal will be seated within the associated slot and channel to engage a conductor in the channel; and an electrically conductive terminal seated within each of the terminal-receiving slots, said terminal having an internal contact portion extending into the associated channel for piercing the insulation of and making electrical engagement with a conductor in the channel, an external contact portion for making electrical engagement with a component external to the housing to establish an electrical connection between the component and the conductor, and oppositely disposed edge portions in compressive engagement with walls of the housing which define the terminal-receiving slot to support the terminal against unintended movement.

* * * * *